United States Patent [19]

Eichner

[11] Patent Number: 4,664,258

[45] Date of Patent: May 12, 1987

[54] DISKETTE HOLDER

[75] Inventor: Falk J. Eichner, Coburg, Fed. Rep. of Germany

[73] Assignee: Eichner Organisation KG, Coburg, Fed. Rep. of Germany

[21] Appl. No.: 720,791

[22] Filed: Apr. 8, 1985

[30] Foreign Application Priority Data

Apr. 28, 1984 [DE] Fed. Rep. of Germany ... 8413069[U]

[51] Int. Cl.[4] ..... B65D 85/57

[52] U.S. Cl. ..... 206/311; 206/312; 206/444; 229/72

[58] Field of Search ..... 206/307, 309, 310–313, 206/425, 444, 445, 555; 229/72; 360/133

[56] References Cited

U.S. PATENT DOCUMENTS

| | | | |
|---|---|---|---|
| 1,360,836 | 11/1920 | Wasisco | 206/312 |
| 2,663,416 | 12/1953 | Hirsch | 206/310 |
| 2,881,912 | 4/1959 | Kursh | 206/312 |
| 3,180,488 | 4/1965 | Heusmann | 206/311 |
| 3,415,365 | 12/1968 | Faulkner | 206/309 |
| 3,432,951 | 3/1969 | Cherrin | 229/72 |
| 3,459,361 | 8/1969 | Matton | 206/312 |
| 3,540,646 | 11/1970 | Kizler | 229/72 |
| 4,022,322 | 5/1977 | Louzil | 206/309 |
| 4,287,989 | 9/1981 | Plummer | 206/387 |
| 4,365,708 | 12/1982 | Tyus | 206/309 |
| 4,508,366 | 4/1985 | Brindle | 206/309 |

FOREIGN PATENT DOCUMENTS

| | | | |
|---|---|---|---|
| 1297703 | 5/1962 | France | 206/311 |
| 0603864 | 4/1960 | Italy | 206/311 |
| 0021009 | 12/1907 | United Kingdom | 206/313 |
| 1337833 | 11/1973 | United Kingdom | 206/312 |

*Primary Examiner*—George E. Lowrance
*Assistant Examiner*—Jimmy G. Foster
*Attorney, Agent, or Firm*—Chilton, Alix & Van Kirk

[57] ABSTRACT

A holder for use in the filling, in a manner which permits easy retrieval, of flat recording media such as floppy disks for use in computers. The holder comprises a sandwich which includes a recess defining intermediate sheet positioned between cover and bottom sheets, the intermediate sheet being formed by a deep-drawing process so as to have side walls which extend generally transverse to the plane of the sheet. Pockets for holding disks are formed between the cover and intermediate sheets by the side walls.

1 Claim, 2 Drawing Figures

DISKETTE HOLDER

BACKGROUND OF THE INVENTION (1) Field of the Invention

This invention relates to the storage of recording media and particularly to improving the ease of filing and retrieving diskettes which contain machine readable data. More specifically, the present invention is directed to improved diskette holders of the type which may be received in albums, table stands or the like. Accordingly, the general objects of the present invention are to provide novel and improved methods and apparatus of such character.

(2) Description of the Prior Art

Holders for recording media, for example diskettes, i.e., "floppy discs", of the type employed for the storage of machine readable data, are well-known in the art. The typical prior art diskette holder is formed from a single blank of thermoplastic sheet material which is folded and subsequently sealed to itself to define a diskette receiving pocket or pockets. During the manufacture of these prior diskette holders, an edge strip is typically folded inwardly and sealed to the remainder of the holder so as to define a channel which receives a hinge pin. Upon insertion of the hinge pin, the holder may be filed in an album, table stand or the like. It is also common practice to provide, at the edge disposed oppositely to the hinge pin, an index receiving member comprised of a transparent material, an identification strip being removably received in this indexing member.

The prior art diskette holders are designed to hold the record media inserted therein by means of friction and thus must tightly abut an inserted diskette. This arrangement, however, impedes the introduction of a diskette into the holder. Furthermore, because of the nature of the thermoplastic sheet material from which the prior holders are fabricated, such holders are lacking in rigidity and this characteristic further increases the difficulty of use and particularly diskette insertion.

SUMMARY OF THE INVENTION

The present invention overcomes the above-briefly discussed and other deficiencies and disadvantages of the prior art by providing a novel technique for storing diskettes and similar flat recording media and by providing an improved holder which implements this novel technique. A diskette holder in accordance with the present invention is characterized by enhanced ease of use, particularly during introduction and removal of diskettes, and by the storage of diskettes inserted therein in a safe and reliable manner. The holders of the present invention are also characterized by sufficient rigidity so as not to complicate disk insertion.

A diskette holder in accordance with the preferred embodiment of the present invention comprises a bottom sheet, an intermediate sheet having a profile which defines a diskette receiving recess, and a cover sheet. The cover sheet overlies at least part of the recess defined by the intermediate sheet and thus cooperates therewith to form a diskette receiving pocket. The cover sheet is affixed to the intermediate sheet which, in turn, is affixed to the bottom sheet to define an integral sandwich-type structure.

In the practice of the present invention the intermediate sheet, i.e., the profiled sheet which defines the record media receiving recess, is formed by a deep drawing process. The side walls of the recess produced during this deep drawing process cooperate with the multiple-layer-areas where the sheets are sealed to one another to reinforce and stiffen the holder. Because of this stiffening, and the fact that the diskette receiving pocket has identifiable side walls, diskette insertion and removal is enchanced and the holder also provides greater protection for a diskette when compared to prior art holders.

Also in accordance with the preferred embodiment of the invention, the intermediate sheet is provided, during the deep-drawing formation process, with retaining bosses which are positioned to engage complementary apertures or recesses in the diskettes. These retaining bosses thus enhance the security of the holder by impeding unintended separation of a diskette from its holder.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE DISCLOSED EMBODIMENT

Figure 1:
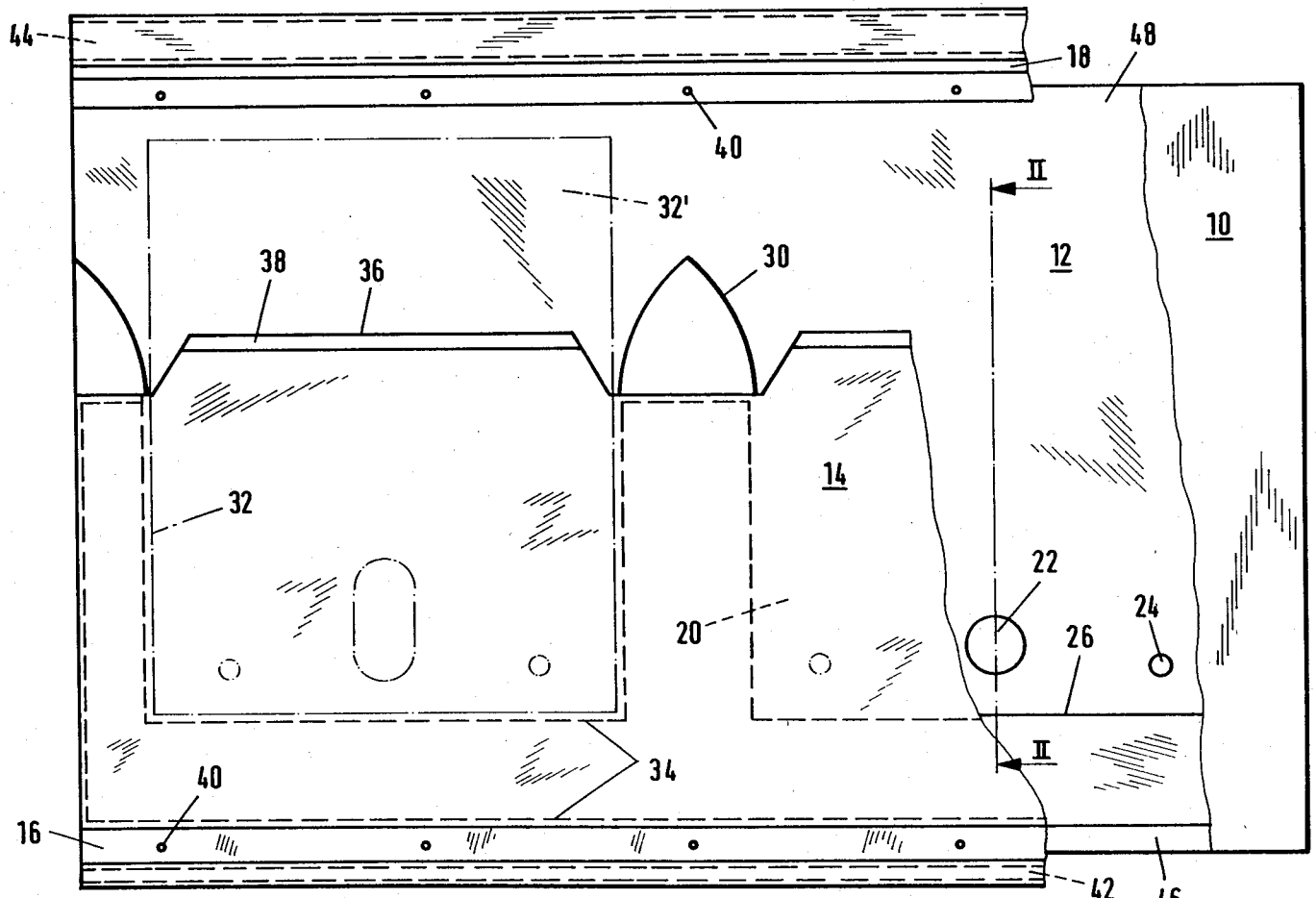
FIG. 1 is a top plan view, partly broken away, of a diskette holder in accordance with the present invention.

With reference now to the drawing, the disclosed diskette holder is comprised of five components. These components comprise a bottom sheet 10, a profiled sheet 12, a cover sheet 14, a hinge-defining edge strip 16 and an index receiving strip 18. The sheets 10, 12 and 14 are typically formed from the same suitable thermoplastic sheet material and this material is capable of shaping by a deep-drawing process. The strip 16 is formed from any suitable plastic material which may be sealed to itself and affixed to the sheets 10, 12 and 14. The strip 18 will be formed from a transparent plastic material which may be sealed to itself and affixed to the sheets 10, 12 and 14.

The profiled sheet 12 is sandwiched between bottom sheet 10 and cover sheet 14. Sheet 12 is shaped, by a deep-drawing process, so as to define a diskette receiving pocket or pockets 20. The deep-drawing step results in sheet 12 being provided with up-standing walls 26 which cooperate with cover sheet 14 to define the pockets 20. A diskette is shown in phantom by means of a broken line at 32 in FIG. 1 and it may be seen, by joint consideration of FIGS. 1 and 2, that the pockets 20 are complementary in shape to and envelope the major portion of a diskette received therein. The deep-drawing step may also be used to form, in sheet 12, retaining bosses as indicated at 22 and 24. These retaining bosses will engage complementary apertures or recesses in a diskette 32 and thereby aid in the retention of the diskette in a pocket 20. The walls 26 terminate, at the ends thereof which approach the insertion end of the holder, in arcuate portions 30. The arcuate portions 30 serve to guide a diskette during insertion into a pocket 20 and thus facilitate use of the holder. As may also be seen by joint consideration of FIGS. 1 and 2, these curved wall portions 30 extend beyond the forward edge 36 of the cover sheet 14 in the disclosed embodiment. The cover sheet is provided, along a strip adjacent the forward edge 36, with an upwardly deflected portion 38. Accordingly, a diskette being inserted in the holder will not "hang-up" on the forward or leading edge of the cover sheet.

Figure 2:
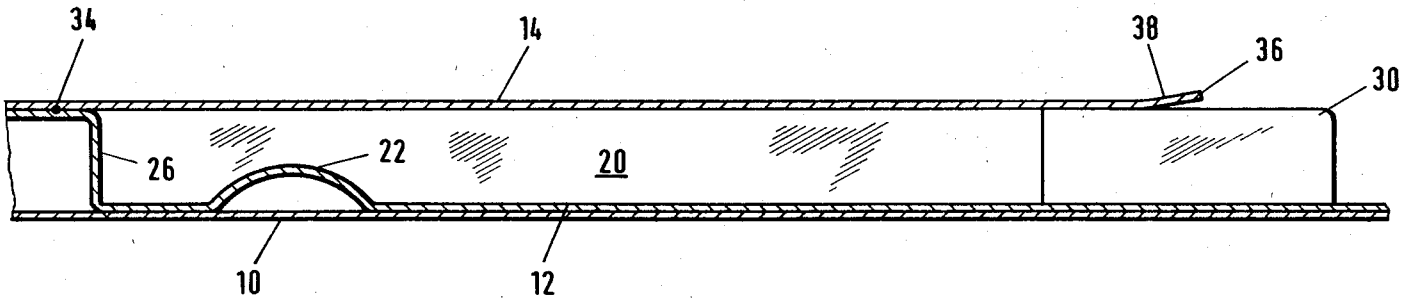
FIG. 2 is an enlarged cross-sectional side elevation view taken along line II—II of FIG. 1.

In the disclosed embodiment, as noted above, the pockets 20 are not co-extensive with the diskettes 32. Thus, a portion 32' of the diskette will extend beyond the forward edge 36 of cover sheet 14 as shown in FIG. 1. Diskettes are commonly provided with a label section adjacent one end, such label sections comprising about one third of the length of the diskette. In the disclosed embodiment of the invention this labelled section will not be covered and thus may be read without withdrawing the diskette from the holder.

After the profiled sheet 12 has been formed, it will be bonded to cover sheet 14 in any suitable manner. In FIG. 1 the sealing joints where sheets 12 and 14 are joined are indicated at 34.

When the sub-assembly comprising sheets 12 and 14 has been completed, this sub-assembly is joined to the bottom sheet 10. This bonding operation is typically performed simultaneously with the cutting of the side edges of sheets 10 and 12 to the desired size. The bonding of the sub-assembly comprising sheets 12 and 14 to the bottom sheet 10 may be performed by any suitable technique.

The next step in the manufacture of a diskette holder in accordance with the present invention comprises the attachment of mounting or filing means. In the disclosed embodiment the mounting means comprises a hinge-defining strip 16. An index receiving strip 18 is customarily joined to the holder at the same time the mounting means is attached. This joining is typically done by spot-welding, the weld spots being indicated at 40 in FIG. 1. Both of strips 16 and 18 are cut from extruded profiles and are generally U-shaped. The side edges 46, 48 of the bottom and profiled sheets 10, 12, which have previously been sealed together, are introduced between the legs of the strips 16 and 18 and the welding performed. In the fabrication of the hinge-defining strip 16 a longitudinal bore, extending the length of the holder, will typically be formed. The bore 42 will be sized to receive a hinge pin (not shown). Similarly, during the formation of the index strip 18 a flat longitudinal channel 44 will typically be formed. The channel 44 is sized for receiving an identification label (not shown).

Employing the hinge pin, the single holder can be filed in an album, a table stand or the like together with additional holders. The identification strip will be at the outer edge of the filed holder.

As will be recognized, the size of the pockets 20 and the position and shape of the bosses 22, 24 will vary as a function of the diskettes to be held. Also, the number of pockets 20 in each holder may vary. Preferably, the width of the curved portions 30 of the vertical walls of the profiled sheet 12 are chosen so that sheet 12 will be cut at its parallel lower and upper edges substantially centrally with respect to the curved wall portion to obtain the desired length.

It is to be noted that, if the holders are to be filed in a loose leaf binder or the like, the mounting strip 16 can comprise a side strap provided with suitably spaced perforations rather than defining the hinge pin receiving longitudinal bore 42.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A holder for use in the storage of flat recording media having recesses or apertures therein, comprising:

a bottom sheet having forward and rear edges;

an intermediate sheet having forward and rear edges, said intermediate sheet being a monolithic element formed of a thermoplastic material and including at least two open topped recesses, said recesses each being defined by integral contoured rear side walls which extend outwardly from the plane of said intermediate sheet, the rear walls being in adjacent, parallel relation to the rear edges of said intermediate sheet, the side walls extending generally transverely to the plane of said sheet and terminating in oppositely disposed arcuate guide walls which diverge outwardly with respect to said recesses, said arcuate walls forming a mouth for each of said recesses, said mouths converging in a direction from the forward to rear of said sheet, said intermediate sheet further including at least one integrally formed resilient projection in each recess, said projections extending outwardly from the plane of said intermediate sheet, said projections being sized and shaped to engage the recess or aperture in said recording media, said intermediate sheet being bonded to said bottom sheet;

a cover sheet having forward and rear edges, said cover sheet being bonded to said intermediate sheet and covering the portion of all said recesses having said projections, said cover sheet and said intermediate sheet cooperating to form a recording media receiving rigid pocket delineated by said walls of said intermediate sheet, said pocket having an insertion opening at the forward end of the recess;

said forward edges of the bottom sheet and the intermediate sheet being bonded together and said rear edges of said cover and intermediate sheets being bonded to each other to form a sandwich holder structure;

mounting means affixed along the rear edges of the cover sheet and intermediate sheet; and indicia receiving means affixed along the forward edges of the intermediate sheet and bottom sheet.

* * * * *